US007029328B1

(12) United States Patent
Mckenzie et al.

(10) Patent No.: US 7,029,328 B1
(45) Date of Patent: Apr. 18, 2006

(54) WATERPROOF ELECTRICAL CONNECTOR

(75) Inventors: Jeffrey A. Mckenzie, Milford, MI (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/051,382

(22) Filed: Feb. 4, 2005

(51) Int. Cl.
*H01R 13/40* (2006.01)

(52) U.S. Cl. ..... 439/587

(58) Field of Classification Search ..... 439/587, 439/271, 272, 274, 275, 681, 752, 477
See application file for complete search history.

(56) References Cited

U.S. PATENT DOCUMENTS 4,684,190 A * 8/1987 Clark et al. ..... 439/587
5,116,236 A * 5/1992 Colleran et al. ..... 439/271
5,575,692 A * 11/1996 Cecil et al. ..... 439/752
5,931,699 A * 8/1999 Saito ..... 439/587
6,183,296 B1 * 2/2001 Pacini et al. ..... 439/577
6,190,203 B1 * 2/2001 Murakami et al. ..... 439/587
6,485,332 B1 * 11/2002 Kwang ..... 439/587
6,527,586 B1 * 3/2003 Okamura et al. ..... 439/587
6,599,153 B1 * 7/2003 Nishide ..... 439/681
6,913,494 B1 * 7/2005 Ward et al. ..... 439/752

* cited by examiner

*Primary Examiner*—Tulsidas C. Patel
*Assistant Examiner*—Harshad Patel
(74) *Attorney, Agent, or Firm*—Osha Liang LLP

(57) ABSTRACT

A connector assembly includes a connector body having a body opening at a rear end of the connector body. The body opening is adapted to receive at least one wire. The connector body has at least one terminal cavity in communication with the body opening. The at least one terminal cavity are adapted to receive terminal ends of the at least one wire. A wire seal is adapted to seal between the at least one wire and the connector body. An interface seal is configured for sealing with the connector body, and is adapted to seal with an inner sheath of a component housing. The connector body and the interface seal are configured such that the interface seal may be positioned on the connector body from the rear end.

19 Claims, 4 Drawing Sheets

WATERPROOF ELECTRICAL CONNECTOR

BACKGROUND OF INVENTION

1. Field of the Invention

The invention relates in general to sealed electrical connectors, and in particular to a sealed connector assembly having an independently positionable TPA and interface seal.

2. Background Art

Sealed connectors, sometimes referred to as waterproof connectors, are commonly used to provide electrical connections in applications requiring a high degree of water resistance, such as in automobile wiring harnesses, appliances, underwater cameras, and other consumer devices. Waterproof connectors typically house one or more terminals secured to one or more terminal wire ends. A waterproof connector may be a male connector or a female connector, although female waterproof connectors are more common. The following descriptions will use female waterproof connectors as examples. However, one of ordinary skill in the art would appreciate that embodiments of the invention are equally applicable to male waterproof connectors.

Safety regulations currently require the use of a "TPA" (terminal position assurance) to assure proper positioning of the terminals within a connector housing. TPAs are used in both sealed and unsealed applications. The TPA locks the terminals in place in the process. Particularly in waterproof connectors, TPAs are frequently designed to also position and secure an interface seal that prevents intrusion of water into the housing. By convention, the end of a female connector that mates with a male connector may be referred to as the "front" end, and the opposite end through which a plurality of wires pass may be referred to as the rear end. Female waterproof connectors typically include "front loaded" interface seals for sealing at least a portion of the housing, as well as front-loaded, dual-function components that function both as a TPA and to energize or at least secure the interface seal. A wire seal, whose function includes preventing intrusion of water where the wires enter the housing, is typically loaded at the rear end, opposite the direction of the interface seal.

U.S. Pat. No. 6,190,203, for example, discloses a front-loaded "waterproof connector" comprising an outer housing, wherein a packing (interface seal) is inserted from the front and a spacer is then inserted from the front to hold the packing. A wire seal is positioned from the rear end of the housing. U.S. Pat. No. 5,931,699 similarly discloses a "waterproof connector," wherein the interface seal is positioned and secured by another component from the front, and the wire seal is positioned from the back.

Some conventional connectors may use a dual-function TPA and seal retainer. These designs, however, may not guarantee proper positioning of the seals until the TPA is inserted to its final position. The TPA is typically fully assembled and positioned downstream in the connector supply and manufacturing chain. TPAs typically have a pre-set position that they are shipped in, and the TPA is inserted into its final position only after all of the female terminals are inserted. The seals risk being improperly positioned or even dislodged in the interim. After the female terminals and TPA are assembled, the female connector is then inserted into the male connector. Furthermore, engagement and disengagement of the TPA with respect to the connector housing, as well as engagement and disengagement of the female connector with respect to the male connector, may each create a pressure change within the housing that can dislodge the interface seal and/or the wire seal.

Conventional connectors having such designs limit the direction of assembly of at least the interface seal. The interface seal must be inserted from the front, such that the TPA may subsequently engage that seal. The wire seal, however, is typically assembled from the rear, and the two seals are therefore assembled from opposite directions, which complicates the manufacturing and assembly process.

Furthermore, conventional connectors may not work on some applications subject to significant size constraints. Downstream manufacturers and suppliers who purchase connectors for further use or assembly typically stipulate size constraints for connector parts and packaging. Dual-function TPA and seal-retaining components impose design limitations, wherein the size of the connector may not be optimized to conform to more stringent sizing requirements.

Regulations governing connector manufacturing, assembly, and installation are subject to change. The seal-retaining feature and the TPA feature in a dual function piece are unnecessarily tied to the same component or set of components. Changes in TPA requirements that dictate modification or elimination of the TPA may undesirably impact design of the seal-retaining feature.

Therefore, there exists a need for better designs of waterproof connectors.

SUMMARY OF INVENTION

According to one aspect of the invention, a connector assembly includes a connector body having a body opening at a rear end of the connector body. The body opening is configured to receive one or more wires. The connector body has one or more terminal cavities in communication with the body opening. The one or more terminal cavities are adapted to receive terminal ends of the one or more wires. A wire seal is adapted to seal with the one or more wires and is configured to seal with the connector body. An interface seal is configured for sealing with the connector body, and is adapted to seal with an inner sheath of a component housing. The connector body and the interface seal are configured such that the interface seal may be positioned on the connector body from the rear end.

Other aspects of the invention include a connector kit, as well as a method of manufacturing a connector assembly.

Further aspects and advantages of the invention will be apparent from the following description and the appended claims.

DETAILED DESCRIPTION

Embodiments of the invention relate to sealed connectors for transmission of electrical signals. In particular, some embodiments relate to a connector assembly for providing a sealed connection between mating male and female connectors. A wire seal and an interface seal may both be assembled in the same direction to a connector body, and particularly both from the rear end. In accordance with some embodiments, a TPA for assuring proper positioning of the terminals may be structurally separate from seal-retaining features. The seals may be fully positioned prior to positioning of the TPA. Aspects of the invention include a sealed connector assembly, a method of manufacturing a sealed connector assembly, and a connector kit.

Figure 1:
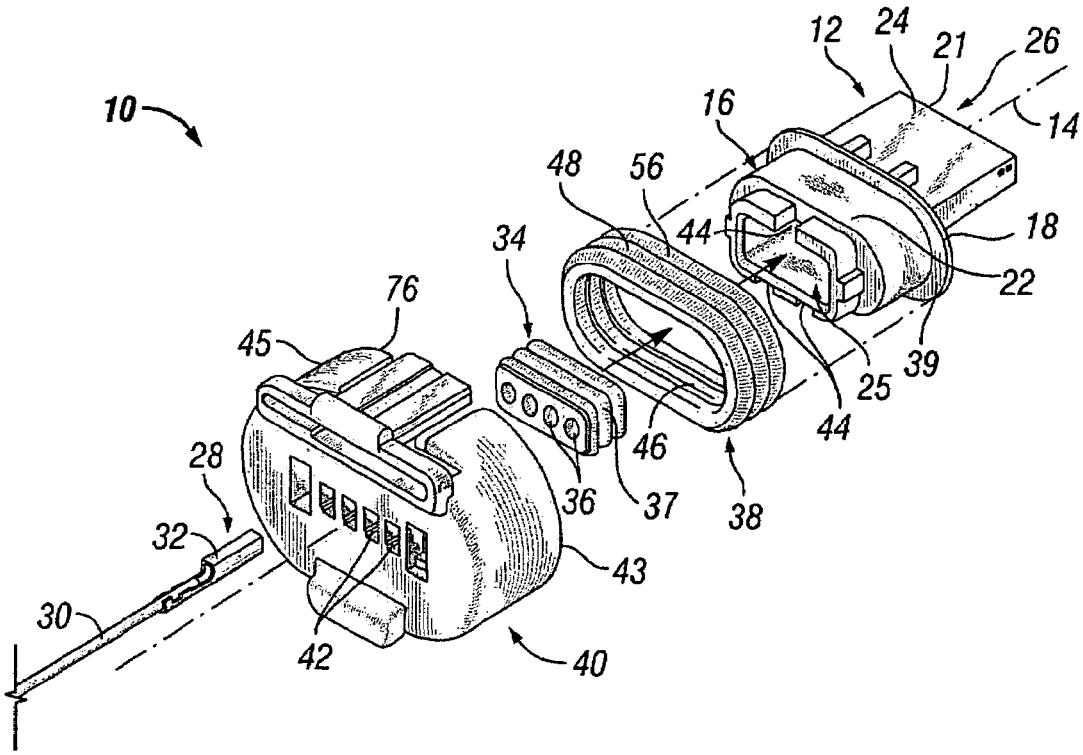
FIG. 1 shows an exploded, perspective view of a connector assembly according to an embodiment of the invention.

FIG. 1 shows an exploded perspective view of a connector assembly generally indicated at 10. Major components of the connector assembly 10 include (from right to left) a connector body 12, an interface seal 38, a wire seal 34, and a back cover 40. Some or all of these components may be manufactured and/or supplied as a connector kit. Typical materials used to manufacture these pieces may include plastic, injection molded polymers, rubber, elastomers, and the like. For example, a manufacturer may form the connector body 12 and back cover 40 out of injection molded plastic, and supply them to purchasers as a kit, with or without the seals 38 and 34, which may be formed from viscoelastic polymers, rubber, gutta percha, or a variety of other materials known in the art for manufacturing seals. The parts may be provided unassembled, such as in FIG. 1, or at least partially assembled, such as in FIG. 3. A kit may include other parts not shown.

Features of the connector assembly 10 may be described with reference to a body axis 14 centrally positioned through the body 12. An axial direction or "axially" is defined herein to include a direction parallel to the body axis 14. A radial direction or "radially" is defined herein to include a direction perpendicular to the body axis 14. Focusing primarily on features of the connector body 12 as shown in FIG. 1, the connector body 12 includes an axially extending collar 16 around the body axis 14. The collar 16 may have an elongate, non-circular cross sectional shape, such as the generally oval or rectangular shape shown. An optional seal stop 18 extends radially outwardly from the collar 16, and is axially spaced from a rear end 20 of the collar 16. The seal stop 18 preferably includes the continuous flange 18 encircling the collar 16 about the body axis 14, as shown. Other possible embodiments of the seal stop 18 may include one or more circumferentially spaced radial projections (not shown) or an annular recess on the collar 16 for receiving the interface seal 38.

The body 12 further includes terminal member 24 extending forward of the seal stop or flange 18. As shown in FIG. 1, the terminal cavities 26 (also shown in FIG. 5) within terminal member 24 pass from an opening 25 of the collar 16 to a forward end 21. The opening 25 in collar 16 is just one example of a feature more generally described as a body opening at rear end 20 through which wires 30 may be passed to the terminal cavities 26. The body opening may also be included in other embodiments (not shown) that do not have an axially extending collar 16, and those having ordinary skill in the art will appreciate that the size and shape of the body opening may vary without departing from the scope of the present invention. Some embodiments of the body opening may instead include a plurality of apertures passing from the rear of the body to the terminal cavities 26.

Figure 6:
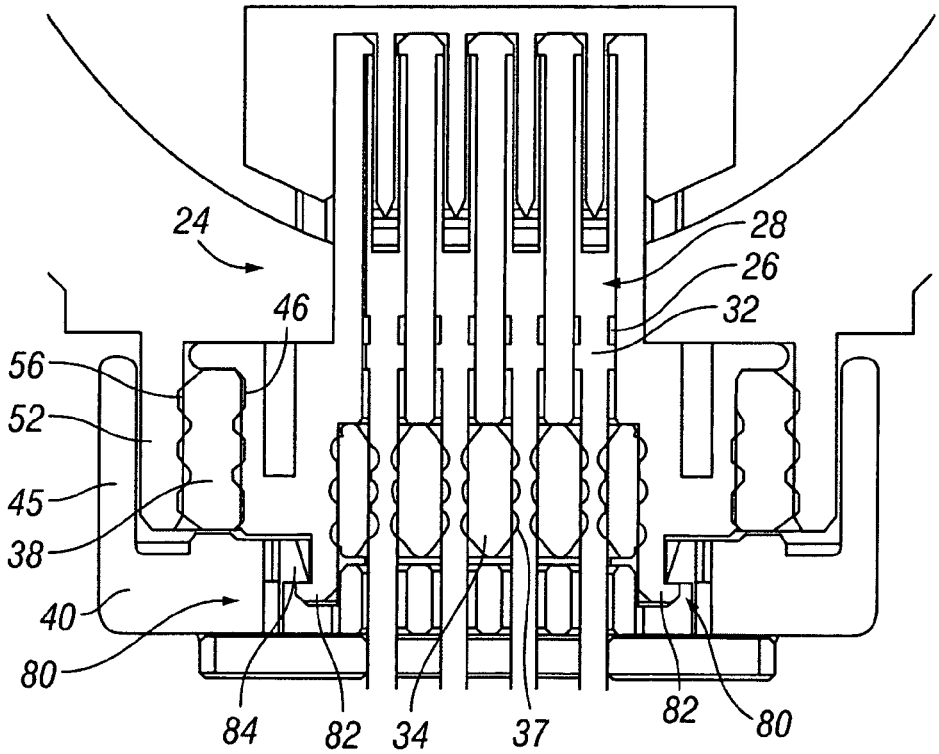
FIG. 6 shows a cross-sectional view, taken along a plane perpendicular to the plane of FIG. 4.

The sectioned view shown in FIG. 6 provides further detail of the terminal member 24. In this particular embodiment, each terminal cavity 26 receives a terminal end 28 of the wire 30 shown in FIGS. 1–3, but in some other embodiments each terminal cavity 26 could conceivably receive a terminal end connected to more than one wire 30. Commonly included at each terminal end 28 is a female terminal 32 (see also FIG. 1).

Figure 2:
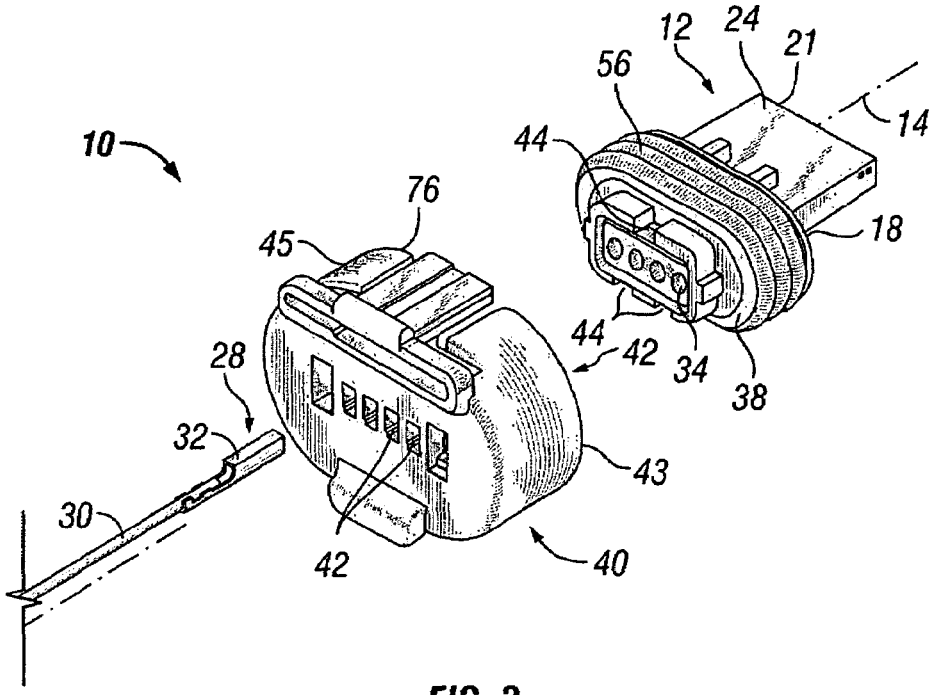
FIG. 2 shows a partially assembled, perspective view of the embodiment of FIG. 1, with outer interface seal and inner wire seal in position on the connector body.

Referring back to FIG. 1, wire seal 34 is positionable at least partially within the body opening 25. The wire seal 34 is fully positioned within the opening 25 as shown in FIG. 2, such that the wire seal 34 does not appreciably extend beyond rear end 20. The wire seal 34 contacts and seals against an inner surface 35 (FIG. 4) of the collar 16. The wire seal 34 may include a plurality of through holes 36, which, when positioned within the collar 16, are at positions corresponding to those of the plurality of terminal cavities 26 for sealingly receiving the one or more wires 30. As shown, the wire seal 34 is a unitary body that includes all the through holes 36. Those of ordinary skill in the art will appreciate that, in other embodiments, multiple wire seals may be included, with each wire seal sealing between an individual wire 30 and the connector body 12.

Referring to FIG. 2, outer interface seal 38 seals against outer surface 22 (shown in FIG. 1) of the collar 16 and may abut the optional seal stop (or flange) 18. In this embodiment, the seal stop 18 includes an optional rear-facing sealing surface 39 (FIG. 1) for sealing with the interface seal 38. The interface seal 38 extends radially outward of the flange 18. As shown in FIG. 2, the connector body 12 and seals 34, 38 are configured such that the interface seal 38 may be positioned on the connector body 12 from the rear end. Interface seal 38 may be slid onto collar 16 from the rear end 20 of the connector body 12, and is thereby positioned behind stop or flange 18. Likewise, wire seal 34 is positioned on the connector body 12 from the rear end 20 when it is pressed forward into body opening 25. Advantageously, this allows both seals 34, 38 to be assembled on the body 12 from the same direction, and in particular from the rear. In other embodiments the wire seal and interface seal may form a unitary seal body, instead of the structurally separate wire seal 34 and interface seal 38. For example, a unitary wire and interface seal may be configured to simultaneously seal within opening 25 and on outer surface 22 of the connector body 12, or otherwise perform the claimed functions of the wire seal and body seal with respect to other embodiments of the connector body.

Figure 3:
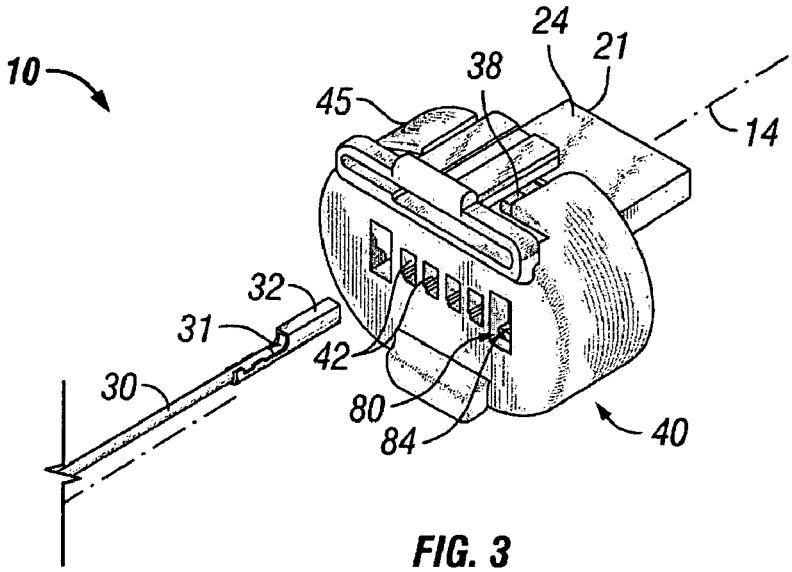
FIG. 3 shows a further assembled, perspective view of the embodiment of FIG. 2, with the back cover locked into position on the connector body.

As shown in the progression from FIG. 1 to FIG. 3, back cover 40 is positioned at rear end 20 of the connector body 12. The back cover 40 at least partially receives and surrounds the connector body 12 from rear end 20. In particular, an outer sheath 45 axially extends toward the connector body 12, surrounding and radially spaced from interface seal 38. The back cover 40 includes one or more through holes 42 for receiving the one or more wires 30. The one or more through holes 42 of the back cover 40 are preferably at positions corresponding to those of the plurality of through holes 36 of the wire seal 34, as shown. In the embodiment illustrated, for example, there are four through holes 42 in the back cover 40, each aligned with and corresponding to one of four through holes 36 in the wire seal 34, and the through holes 36 are each aligned with and corresponding to one of four terminal cavities 26.

In other embodiments, however, it is conceivable that the number of through holes in the back cover may be different from that of a wire seal. For example, one embodiment might include two through holes in the back cover passing two wires each, or even just a single through hole or entrance passing all four wires; and the wire seal may have four through holes, each passing and sealing against a single wire. It is preferable in such other embodiments, however, that the through holes of the back cover are substantially aligned with the through holes of the wire seal, such that each wire may follow a substantially straight-line path from the back cover, through the wire seal, and to the terminal cavities.

Figure 4:
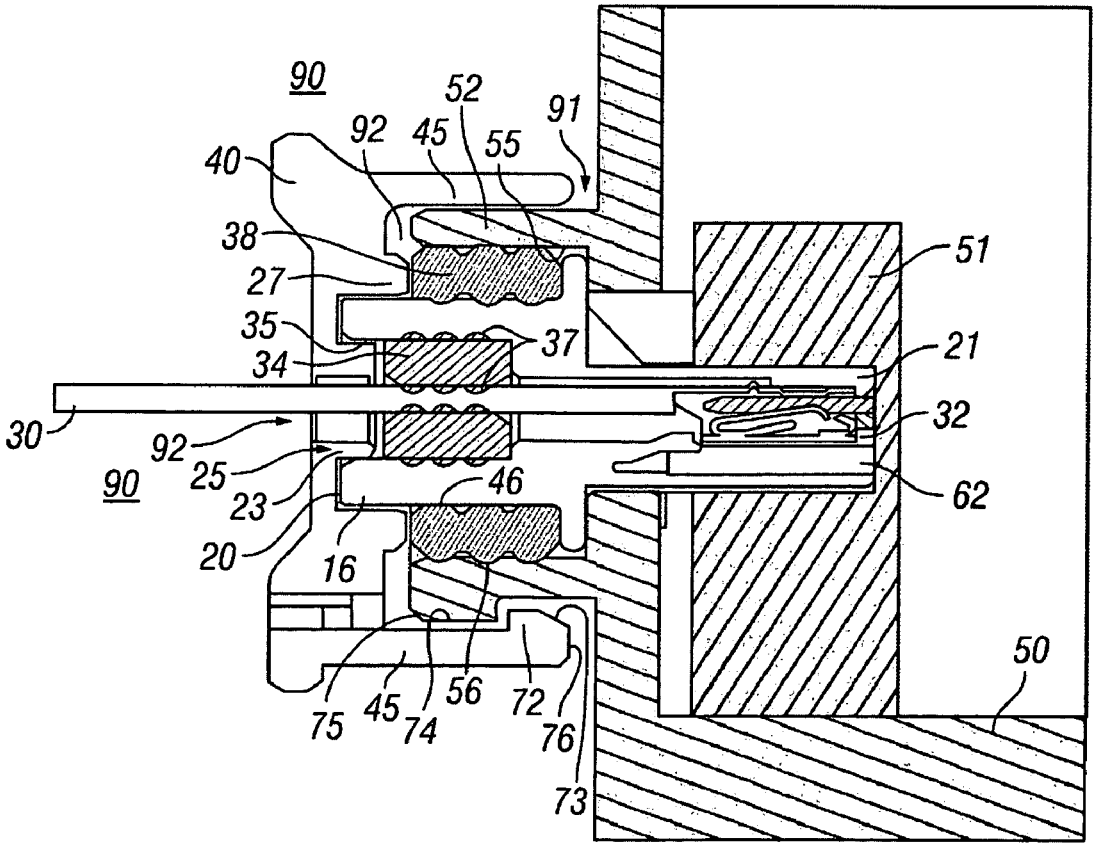
FIG. 4 shows a cross-sectional view of the connector assembled to the component housing.

Referring to FIG. 4, the back cover 40 axially engages the interface seal 38 and the wire seal 34, to position, retain, and/or energize the interface seal 38 and the wire seal 34. Interface seal 38 and wire seal 34 are substantially flush with or slightly forward of rear end 20 in this example. Therefore, to engage seals 34, 38, an axially extending inner protrusion 23 at least partially encircling body axis 14 protrudes into the opening 25 of the collar 16 to engage wire seal 34. Also, an axially extending outer protrusion 27 protrudes between outer surface 22 (FIG. 1) of collar 16 and outer sheath 45 of back cover 40 to engage interface seal 38. In other embodiments, however, one or both of the seals 34, 38 may protrude rear past rear end 20, in which case the back cover 40 may be configured with a substantially flat (i.e. non-protruding) inner surface to engage the seals 34, 38. In yet other embodiments, the wire seal 34 and interference seal 38 comprise a unitary body having a linking piece (not shown) connecting these seals. The linking piece may form a seal against the back cover 40.

As illustrated in FIGS. 3 and 6, a locking member 80 is provided to lock the back cover 40 to the connector body 12 to maintain positioning and/or engagement of the interface seal 38 and wire seal 34. In this embodiment, the locking member 80 includes a protrusion 82 on the collar 16 having a radial component inserted into a recess 84 on the back cover 40. The protrusion 82 "snaps" into the recess 84 when the back cover 40 is fully engaged with the connector body 12. This locking engagement prevents axial separation of the back cover 40 and the connector body 12. Referring again to FIG. 4, in combination with the inner and outer protrusions 23, 27 for engaging the wire seal 34 and interface seal 38, this locking engagement allows the seals 34 and 38 to be effectively "locked" into proper position and alignment prior to securing the connector body 12 to component housing 50, which is discussed below.

Referring to FIG. 2, in some embodiments, one or more sliding projections 42 are provided (hidden from view) on an interior 43 of the back cover 40, and one or more axially extending recesses 44 are provided on the collar 16, for slidably receiving the sliding projections 42. The recesses 44 and projections 42 guide the back cover 40 with respect to the connector body 12 during engagement of the back cover 40 with the connector body 12. In alternative embodiments, the axially extending recesses may instead be provided on the back cover 40, and the sliding projections may instead be provided on the collar 16. The sliding projections 42 and recesses 44 help position and align the interface seal 38 and wire seal 34 during the locking engagement discussed above. One of ordinary skill in the art would appreciate, however, that these features are not mandatory. Thus, some embodiments of the invention may not include the sliding projections and the recesses.

Figure 7:
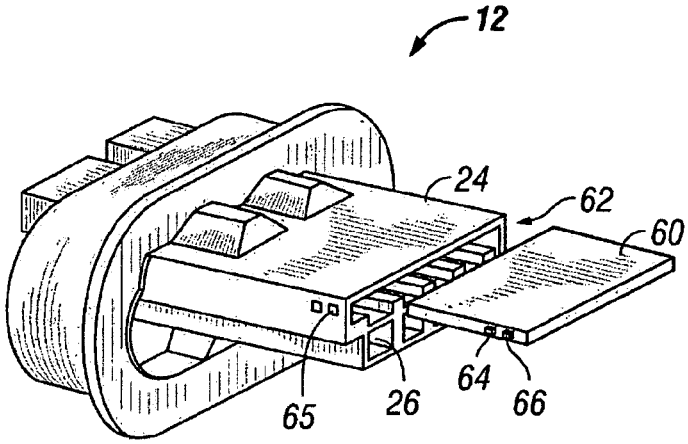
FIG. 7 shows the terminal portion of the connector body having a slot configured for receiving the wafer-shaped TPA member that is moveable between a first position and a second position.
Figure 8:
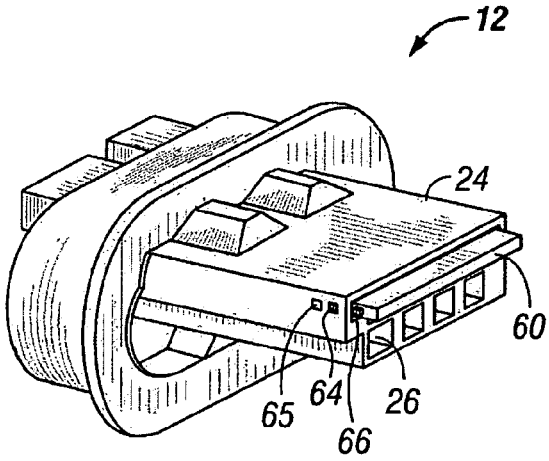
FIG. 8 shows the TPA member in the first position.
Figure 9:
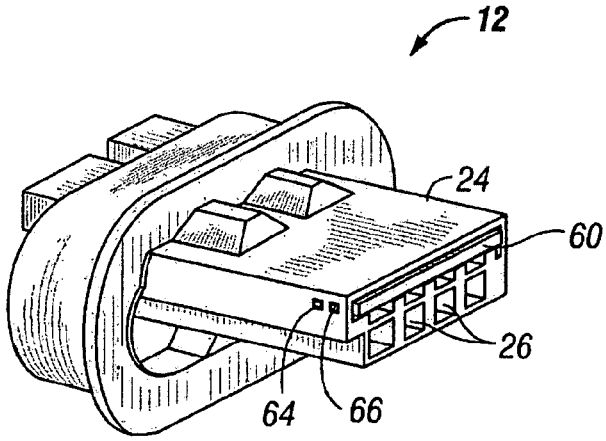
FIG. 9 shows the TPA member in the second position.

FIGS. 7–9 illustrate one embodiment of a TPA mechanism, in accordance with one aspect of the invention, by which terminal wire ends 30 may be properly seated and secured within terminal cavities 26. For simplicity of illustration, however, the back cover 40 and seals 34, 38, along with the wires 30 and terminal ends 28 thereof, are absent from FIGS. 7–9—those features are referenced in FIGS. 1–3. A TPA opening 62 at the terminal member (i.e. terminal portion) 24 of the connector body 12 may pass to and at least partially intersect the terminal cavities 26 in such a way that a TPA member 60 can be inserted into the TPA opening 62 above the terminal ends 28 of the wires 30 to limit movement of the terminal ends 28 within terminal cavities 26. In the particular embodiment shown in FIGS. 7–9, the TPA opening 62 is a slot on the front of the terminal member 24, and the TPA member 60 is wafer-shaped to pass into the TPA opening 62. The TPA opening 62 in this embodiment is substantially parallel to the terminal cavities 26, so that the TPA member 60 slides into the TPA opening 62 above and parallel to the female terminals (shown as 32 in FIG. 4). In other embodiments, the TPA opening and TPA member may be oriented in any of the X, Y, or Z directions, e.g. the TPA member may be inserted from the side or from the top of the terminal member 24 to engage the terminal ends 28 and ensure their positioning.

Figure 5:
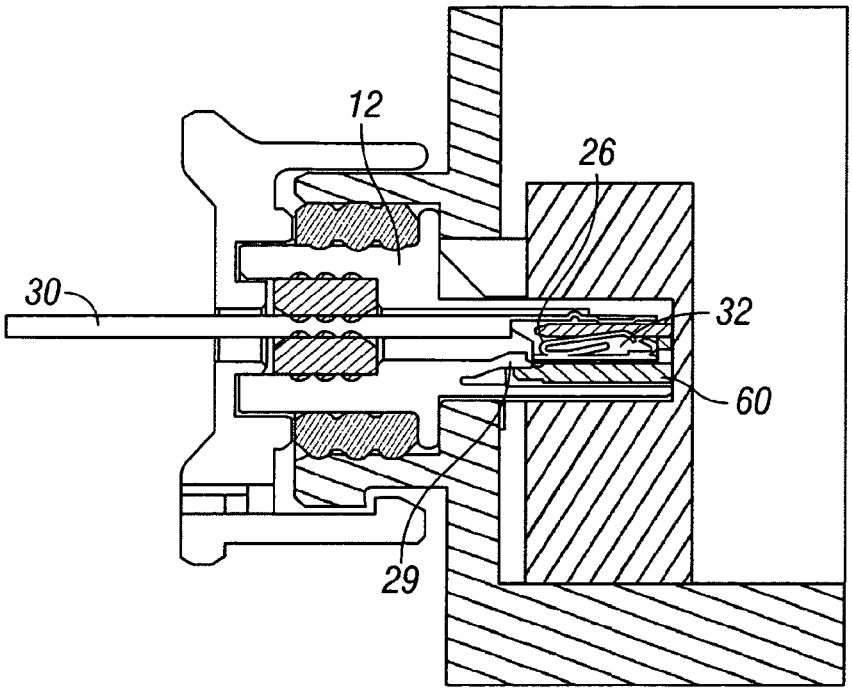
FIG. 5 shows a cross-sectional view in the same plane as FIG. 4, with the TPA member inserted into the TPA slot.

FIG. 5 further illustrates the embodiment of the TPA mechanism of FIGS. 7–9. In FIG. 5, the TPA member 60 has been inserted into the TPA slot 62 (whereas the TPA member 60 is not inserted in FIG. 4). At least one terminal lance 29 is formed on the connector body 12. Prior to insertion of the TPA member 60, the terminal lance 29 may be flexed radially so that female terminal 32 may slide past terminal lance 29 and "snap" into position within terminal cavity 26 during insertion of the wire 30. Once snapped into position, a catch 31 on female terminal 32 (FIG. 3) may engage the terminal lance 29 to help prevent removal of the female terminal 32. The terminal lance 29 thereby provides an "initial lock" of the female terminal 32. Without the TPA member 60 in place (as in FIG. 4), however, the terminal lance may still be flexed downward, such as by leveraging with a narrow instrument inserted into terminal cavity 26, or possibly by forcibly pulling on wire 30. With TPA member 60 inserted as in FIG. 5, radial flexing of the terminal lance 29 is restricted, to prevent or at least minimize the likelihood of removal of the female terminal 32. This is one aspect of "terminal position assurance," i.e. assuring that once positioned, the female terminals 32 are unlikely to be removed inadvertently.

In some embodiments, the TPA member is moveable between multiple positions. As illustrated in FIGS. 7–9, the TPA member 60 may be movable within the TPA opening 62 between a first position (FIG. 8), wherein the TPA member 60 at most partially interferes with the terminal lances 29 (discussed in connection with FIG. 5), and a second position (FIG. 9) wherein the TPA member 60 is more fully inserted to more fully limit motion of the terminal lances 29. This is useful, for example, when the connector assembly 10 is shipped with connector body 12, back cover 40, seals 34, 38, and TPA member 60, for subsequent assembly with the wires 30. In the first position (FIG. 8), the TPA member 60 is retained by a first pair of protrusions 64 passing through slot 65. In this first position, the terminal lances 29 may flex, to allow insertion of terminal ends 28 of wires 30. After inserting the terminal ends 28, the TPA member 60 can be moved to the second position (FIG. 9), retained by protrusions 66, to secure the terminal ends 28. The protrusions 64 and 66 may be inwardly movable and biased outwardly to "snap" into slot 65.

Referring still to FIGS. 7–9, the TPA member is structurally separate from the components that position and retain the seals 34, 38. As discussed above, for example, the seals 34, 38 may be positioned on the connector body 12 and secured/retained between the back cover 40 and the seal stop or flange 18. Because the TPA member 60 is structurally separate, it may be positioned independently of the step of positioning and/or retaining the seals, in contrast to conventional sealed connectors wherein the TPA is positioned concurrently with or dependent upon positioning of the interface seals from the front end. This is useful, for example, to allow the connector assembly (shown as 10 in FIG. 1) or some portion thereof to be shipped or handled prior to installation of the TPA. This is also useful when connectors embodying aspects of the invention require independent design or redesign of either the TPA or seal-retaining components. The TPA-related features may be designed independently of the seal-retaining features.

FIG. 4 shows the sub-assembly of FIG. 3 assembled to a component housing 50, to complete a sealed electrical connection. The terminal portion 24 of the connector body 12 is shown "plugged into" representative component 51 that is mounted to the component housing 50. The component housing 50 has an axially extending inner sheath 52 positionable between the interface seal 38 and the axially extending outer sheath 45 of the back cover 40. The inner sheath 52 may thereby protect, enclose, and/or seal against radially outward portion 48 or ribs 56 of the interface seal 38.

The wire seal 34 may include a plurality of radially extending outer ribs 37 for sealingly contacting the inner surface 35 of the collar 16. The interface seal 38 may include a plurality of radially extending inner ribs 46 for sealingly contacting the outer surface 22 of the collar 16. The interface seal 38 may also include radially extending outer ribs 56 for sealingly contacting the outer sheath 52 of the component housing 50.

According to some embodiments, the back cover 40 and component housing 50 may be locked together. Still referring to FIG. 4, an inwardly extending flange 72 is disposed on a locking portion 76 of the back cover 40, and an outwardly extending flange 74 is disposed on the inner sheath 52 of the component housing 50. The locking portion 76 includes a tapered portion 73. Another, optional tapered portion 75 is included on the component housing 50, such that the tapered portion 73 of the locking portion 76 axially engages the tapered portion 75. As the inner and outer sheaths 52 and 45 are axially moved toward one another, the locking portion 76 is flexed to radially separate the flanges 72, 74. With further axial movement between the inner and outer sheaths 52 and 45, the flanges 72 and 74 slide past one another and snap back to the locked position of FIG. 4. The back cover 40 is thereby locked to component housing 50, wherein the outwardly extending flange 74 is radially overlapping the inwardly extending flange 72.

With the connector assembly 10 fully assembled with the housing 50, as illustrated in FIG. 4, the sealed connector assembly 10 is water-resistant or substantially waterproof. In applications such as automobiles, wherein the connector assembly 10 may be installed under the hood of a car, the connector housing 50 may be exposed to rainy or otherwise wet conditions, as well as to ambient air that may carry contaminants. The embodiment shown in FIG. 4 is particularly advantageous in shielding the sensitive internal electrical components, such as the wires 30 and female terminals 32, from water and other contaminants. For example, external region 90 of FIG. 4 may be exposed to ambient conditions such as water and wind contaminants. These elements may attempt to enter the connector assembly 10 at region 91 between the outer flange 45 and inner flange 52. If inner sheath 52 contacts outer sheath 45 snugly, water and contaminants may be prevented from moving past region 91. Any water or contaminants that get past region 91 to region 92 will be sealed out by interface seal 38, which preferably seals with both outer surface 22 of collar 16 and an inner surface 55 of inner sheath 52. Interface seal 38 may further provide some sealing at rear flange surface not in FIG. 4, in the unlikely instance that contaminants reach that location. Water or contaminants in ambient region 90 attempting to enter the connector assembly 10 at location 92 between the wires 30 and the through holes 42 will be sealed out by wire seal 34. The sets of ribs 37, 46, 56 help ensure effective sealing. This sealed configuration ultimately helps maintain a reliable electrical connection between terminal member 24 of the connector body 12 and component 51 by protecting these and other internal components from harmful environmental elements.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector assembly comprising:

a connector body having a body opening at a rear end of the connector body, the body opening adapted to receive at least one wire, and at least one terminal cavity in communication with the body opening, the at least one terminal cavity being adapted to receive terminal ends of the at least one wire;

a wire seal adapted to seal with the at least one wire, and is configured to seal with the connector body;

an interface seal for sealing with the connector body, the interface seal adapted to seal with an inner sheath of a component housing; and a back cover positioned at the rear end of the connector body, the back cover having at least one through hole configured for passing the at least one wire to the body opening;

wherein the connector body and the interface seal are configured such that the interface seal is positioned on the connector body from the rear end.

2. The connector assembly of claim 1, wherein the wire seal is configured for positioning on the connector body from the rear end.

3. The connector assembly of claim 1, wherein the wire seal is positioned at least partially within the body opening.

4. The connector assembly of claim 1, wherein the connector body further comprises:

an axially extending collar positioned around a body axis, the axially extending collar defining an outer sealing surface for sealing engagement with the interface seal and an inner sealing surface for sealing with the wire seal.

5. The connector assembly of claim 1, wherein the back cover further comprises:

an axially extending outer sheath at least partially surrounding the interface seal.

6. The connector assembly of claim 5, further comprising:

an inwardly extending flange disposed on the outer sheath of the back cover and adapted to lock with an outwardly extending flange disposed on the inner sheath of the component housing.

7. The connector assembly of claim 6, wherein a portion of at least one of the inner sheath and the outer sheath is radially flexible to an unlocking position.

8. The connector assembly of claim 1, wherein the back cover axially engages at least one of the interface seal and the wire seal in a forward direction.

9. The connector assembly of claim 8, further comprising:

at least one of a first protrusion on the back cover for axially engaging the interface seal and a second protrusion on the back cover for axially engaging the wire seal.

10. The connector assembly of claim 1, further comprising:

a seal stop disposed on the connector body for limiting forward movement of the interface seal with respect to the connector body.

11. The connector assembly of claim 10, wherein the seal stop comprises:

an annular flange.

12. The connector assembly of claim 1, further comprising:

a locking mechanism for preventing axial separation of the back cover and the connector body.

13. The connector assembly of claim 1, wherein at least one of the connector body, the interface seal, and the wire seal comprises an elongate, noncircular cross section.

14. The connector assembly of claim 1, wherein the connector body comprises a terminal portion housing the at least one terminal cavity, the terminal portion being adapted for electrical communication with a component secured to the component housing.

15. The connector assembly of claim 1, further comprising:

a terminal portion of the connector body that houses the at least one terminal cavity;

a TPA opening at the terminal portion of the connector body, the TPA opening passing to the at least one terminal cavity; and a TPA member configured to be inserted into the TPA opening adjacent the terminal ends of the at least one wire, such that the TPA member limits radial movement of the terminal ends.

16. The connector assembly of claim 15, further comprising:

a terminal lance providing interference with the terminal ends as they are inserted into the terminal cavities, the terminal lance being movable in response to insertion of the terminal ends.

17. The connector assembly of claim 16, further comprising:

the TPA member being movable within the TPA opening between a first position, wherein the terminal lance remains sufficiently movable to allow insertion or removal of the terminal ends, and a second position, wherein the TPA member interferes with movement of the terminal lance to prevent removal of the terminal ends.

18. A kit comprising:

a connector body having a body opening at a rear end of the body, the body opening adapted for receiving at least one wire, and at least one terminal cavity in communication with the body opening, the at least one terminal cavity being adapted to receive terminal ends of the at least one wire;

a wire seal adapted to seal with the at least one wire, and is configured to seal with the connector body;

an interface seal configured to seal with the connector body, the interface seal adapted to seal with an inner sheath of a component housing, wherein the connector body and the interface seal are configured such that the interface seal may be positioned on the connector body from the rear end; and a back cover configured to position at the rear end of the connector body, the back cover having at least one through hole configured to pass the at least one wire to the body opening, and an axially extending outer sheath configured to at least partially surround the interface seal when positioned at the rear end of the connector body.

19. A method of manufacturing a connector assembly, comprising:

forming a connector body having a body opening at a rear end of the connector body;

wherein the body opening is adapted to receive at least one wire and wherein the connector body is configured to receive an interface seal from the rear end;

forming at least one terminal cavity in the connector body in communication with the body opening;

wherein the at least one terminal cavity receives terminal ends of the at least one wire; and forming a back cover having at least one through hole;

wherein the back cover is positioned at the rear end of the connector body and configured for passing the at least one wire to the body opening.

* * * * *